US010537144B1

(12) United States Patent
Suttman et al.

(10) Patent No.: US 10,537,144 B1
(45) Date of Patent: Jan. 21, 2020

(54) BREAK-AWAY TUBING FOR TECHNOLOGY GEAR

(71) Applicant: Vaprwear Gear LLC, Englewood, CO (US)

(72) Inventors: Steven Suttman, Castle Pines, CO (US); Tom Gruger, Greenwood Village, CO (US); Marietta Cantu, Aurora, CO (US)

(73) Assignee: VAPRWEAR GEAR LLC, Denver, CO (US)

( * ) Notice: Subject to any disclaimer, the term of this patent is extended or adjusted under 35 U.S.C. 154(b) by 223 days.

(21) Appl. No.: 15/681,231

(22) Filed: Aug. 18, 2017

Related U.S. Application Data

(63) Continuation-in-part of application No. 15/005,899, filed on Jan. 25, 2016, now Pat. No. 10,034,503,
(Continued)

(51) Int. Cl.
*A42B 3/04* (2006.01)
*A41D 27/20* (2006.01)
(Continued)

(52) U.S. Cl.
CPC ..... *A41D 27/20* (2013.01); *A24F 3/00* (2013.01); *A24F 47/004* (2013.01); *A41D 1/002* (2013.01);
(Continued)

(58) Field of Classification Search
CPC ... A42B 3/048; A45F 3/04; A45F 3/16; B67D 2210/00131
See application file for complete search history.

(56) References Cited

U.S. PATENT DOCUMENTS 1,900,129 A 3/1933 Ring
2,078,844 A 4/1937 Gardian
(Continued)

FOREIGN PATENT DOCUMENTS

CN 106714600 5/2017
EP 3169172 A2 5/2017
(Continued)

OTHER PUBLICATIONS

International Search Report and Written Opinion for PCT/US15/40787 dated Jan. 12, 2016, all pages.
(Continued)

*Primary Examiner* — Tajash D Patel
(74) *Attorney, Agent, or Firm* — Stanley J. Gradisar; Stanley J. Gradisar Attorney At Law, LLC

(57) ABSTRACT

Technology devices may be concealed in and outside of conduit's in clothing and accessories. To that end, described herein, are releasable couplers and tube assemblies that can be affixed to clothing and other accessories for safe concealment of technology devices and accessories and to avoid strangulation and other accidental harm should an accessory get snagged, caught, or pulled. The releasable coupler and releasable tube assemblies will "break-away" from each other or the component or accessory they are attached to when undo pressure is applied. The integration of the releasable coupler and the releasable tube assembly allow one to imbibe inconspicuously and safely. The releasable coupler and releasable tube assemblies also allow for easy removal for cleaning and maintenance purposes.

20 Claims, 12 Drawing Sheets

Related U.S. Application Data which is a continuation of application No. 14/801,451, filed on Jul. 16, 2015, now Pat. No. 9,332,796.

(60) Provisional application No. 62/376,847, filed on Aug. 18, 2016, provisional application No. 62/025,829, filed on Jul. 17, 2014.

(51) Int. Cl.

| | |
|---|---|
| ***A45F 3/20*** | (2006.01) |
| ***A24F 47/00*** | (2006.01) |
| ***A41D 1/04*** | (2006.01) |
| ***A24F 3/00*** | (2006.01) |
| ***A41D 27/24*** | (2006.01) |
| ***A41D 1/00*** | (2018.01) |
| ***A41D 1/02*** | (2006.01) |
| ***A41D 13/00*** | (2006.01) |

(52) U.S. Cl.

CPC ..... *A41D 1/02* (2013.01); *A41D 1/04* (2013.01); *A41D 13/0012* (2013.01); *A41D 27/24* (2013.01); *A42B 3/048* (2013.01); *A45F 3/20* (2013.01); *A41D 2200/20* (2013.01); *A41D 2400/46* (2013.01)

(56) References Cited

U.S. PATENT DOCUMENTS

| | | | | |
|---|---|---|---|---|
| 2,426,726 | A | 9/1947 | Combs | |
| 4,070,553 | A | 1/1978 | Hass | |
| 4,243,058 | A | 1/1981 | Gershbein | |
| 4,322,585 | A | 3/1982 | Liautaud | |
| 4,526,298 | A | 7/1985 | Boxer et al. | |
| 4,544,087 | A | 10/1985 | Modig | |
| 4,589,134 | A | 5/1986 | Waldron | |
| 4,876,724 | A | 10/1989 | Suzuki | |
| 4,948,023 | A | 8/1990 | Tripp | |
| 5,400,934 | A | 3/1995 | Ducros | |
| 5,416,310 | A | 5/1995 | Little | |
| 5,555,490 | A | 9/1996 | Carroll | |
| 5,722,573 | A | 3/1998 | Camel | |
| 5,816,457 | A | 10/1998 | Croft | |
| 5,901,889 | A | 5/1999 | Ho | |
| 5,940,880 | A | 8/1999 | Phillips | |
| 6,220,490 | B1 | 4/2001 | O'Hara | |
| 6,339,846 | B2 | 1/2002 | Uchida | |
| 6,801,140 | B2 | 10/2004 | Mantyjarvi et al. | |
| 6,826,782 | B2 | 12/2004 | Jordan | |
| 7,168,098 | B2 | 1/2007 | West | |
| 7,265,970 | B2 | 9/2007 | Jordan | |
| 7,302,710 | B2 | 12/2007 | Thomas et al. | |
| RE40,613 | E | 1/2009 | Jordan | |
| 7,519,192 | B1 | 4/2009 | Laycock et al. | |
| 7,673,348 | B2 | 3/2010 | Williams | |
| 7,841,344 | B2 | 11/2010 | Schlosser | |
| 7,992,225 | B2 | 8/2011 | Demus | |
| 8,107,653 | B2 | 1/2012 | Wolfe | |
| 8,549,670 | B2 | 10/2013 | Demus | |
| 8,613,112 | B2 | 12/2013 | Santucci et al. | |
| 8,687,834 | B2 | 4/2014 | Wolfe | |
| 8,756,716 | B2 | 6/2014 | Jordan et al. | |
| 9,009,867 | B2 | 4/2015 | Bowen et al. | |
| 9,332,796 | B2 | 5/2016 | Edwards et al. | |
| 2002/0124294 | A1 | 9/2002 | McKenzie et al. | |
| 2007/0034634 | A1* | 2/2007 | Brown | A45F 3/16 220/703 |
| 2007/0090135 | A1* | 4/2007 | Benham | A45F 3/20 224/148.2 |
| 2008/0067202 | A1 | 3/2008 | Silva et al. | |
| 2010/0308086 | A1 | 12/2010 | Chapuis | |
| 2012/0045084 | A1 | 2/2012 | Groset et al. | |
| 2014/0053854 | A1 | 2/2014 | Barry, Jr. | |
| 2014/0304885 | A1 | 10/2014 | Oliver | |
| 2015/0001253 | A1* | 1/2015 | Slaton | A45F 3/16 222/144.5 |
| 2015/0196061 | A1 | 7/2015 | Oliver | |
| 2016/0309819 | A1 | 10/2016 | Edwards et al. | |
| 2018/0035787 | A1* | 2/2018 | Jaeger | A42B 3/0406 |
| 2018/0372524 | A1* | 12/2018 | Saville | A45F 3/04 |

FOREIGN PATENT DOCUMENTS

| | | | |
|---|---|---|---|
| WO | 02/080714 | A1 | 10/2002 |
| WO | 2008/025043 | A1 | 3/2008 |

OTHER PUBLICATIONS

International Preliminary Report on Patentability for PCT/US15/40787 dated Sep. 16, 2016, all pages.

Partial supplementary European search report and provisional opinion for EP Application No. 15821812.5 dated Jan. 12, 2018, 14 pages.

* cited by examiner

BREAK-AWAY TUBING FOR TECHNOLOGY GEAR

CROSS-REFERENCES TO RELATED APPLICATIONS

The present application is a non-provisional of and claims priority to U.S. Provisional Application No. 62/376,847, filed Aug. 18, 2016, which is hereby incorporated by reference in its entirety for all purposes. This application is a Continuation-In-Part of U.S. Nonprovisional application Ser. No. 15/005,899, filed Jan. 25, 2016, which is a continuation of U.S. Pat. No. 9,332,796, issued May 10, 2016, which is a non-provisional of and claims priority to U.S. Provisional Patent Application No. 62/025,829, filed Jul. 17, 2014; all of which are hereby incorporated by reference in their entirety.

The present application is also related to U.S. Nonprovisional application Ser. No. 15/681,239, filed concurrently herewith which is hereby incorporated by reference in its entirety for all purposes.

BACKGROUND OF THE INVENTION

Technology such as drinking flasks, hydration bladders, vapor pens, oxygen generators, music players, etc. have become necessities of modern life to some. Persons who choose to drink smoke, or vape in public must currently do so in a manner that is very conspicuous and even irritating to others. Often, persons who prefer to enjoy their vices in public places may wish to be more discreet about their "habit." There exists a dearth of mechanisms that assist in allowing a person to imbibe inconspicuously. There exists a need to integrate different configurations and sizes of technology in an easy and convenient way to make the drink, smoke, and vape technology portable, safe, and inconspicuous.

A portion of the disclosure of this patent document contains material, which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

BRIEF SUMMARY OF THE INVENTION

One general aspect of the present invention includes a technology coupler for anchoring a tube in a body-worn item to promote fast uncoupling for maintenance, the technology coupler including: a first port that is configured to releasably couple to a first tube to the technology coupler without fluid leaking; a second port that is configured to releasably couple to a second tube to the technology coupler without fluid leaking, where the first port is in fluid communication with the second port; and an anchor, where: the anchor is affixed to a body-worn item; the anchor holds the first port and the second port in a location proximate to the body-worn item; and the anchor is affixed in a concealed location of the body-worn item such that at least one of the first tube or second tube passes into the body-worn item to mate with its respective port.

Additional implementations of this aspect of the present invention may include one or more of the following features. Another embodiment of this aspect is the technology coupler for anchoring a tube in a body-worn item to promote fast uncoupling for maintenance where the first tube is non-releasably coupled to the first port, and/or the second tube is permanently affixed to the second port. Yet another embodiment is the technology coupler for anchoring a tube in a body-worn item to promote fast uncoupling for maintenance further including an affixing mechanism including a magnet, a hook and loop fastener, a button, a button hole, and/or an eyelet. A further embodiment is the technology coupler for anchoring a tube in a body-worn item to promote fast uncoupling for maintenance where the first port and the second port are rigid or semi-rigid. An additional embodiment is the technology coupler for anchoring a tube in a body-worn item to promote fast uncoupling for maintenance where the anchor is affixed to the body-worn item removably or non-removably. And yet another embodiment is the technology coupler for anchoring a tube in a body-worn item to promote fast uncoupling for maintenance where the first port and the second port are high-heat stable. Another embodiment includes the technology coupler for anchoring a tube in a body-worn item to promote fast uncoupling for maintenance where the first port and the second port include food grade plastic material.

A second general aspect of the present invention includes a technology coupler for anchoring a tube in a body-worn item to promote fast uncoupling for avoiding accidental catching, the technology coupler including: a first port coupled to a first tube to the technology coupler; a second port that is configured to releasably couple to a second tube to the technology coupler without fluid leaking, where the first port is in fluid communication with the second port; and an anchor, where: the anchor is affixed to a body-worn item; the anchor holds the first port in a location proximate to the body-worn item; and the anchor is affixed in a concealed location of the body-worn item such that at least one of the first tube or second tube passes into the body-worn item to mate with its respective port.

Additional embodiments of this aspect of the invention may include one or more of the following features. A first additional embodiment of this aspect is the technology coupler for anchoring a tube in a body-worn item to promote fast uncoupling for avoiding accidental catching where the first port is configured to releasably couple to the first tube. Another embodiment is the technology coupler for anchoring a tube in a body-worn item to promote fast uncoupling for avoiding accidental catching where the first port and the second port are rigid or semi-rigid. A further embodiment is the technology coupler for anchoring a tube in a body-worn item to promote fast uncoupling for avoiding accidental catching where the anchor is affixed to the body-worn item removably or non-removably. An additional embodiment is the technology coupler for anchoring a tube in a body-worn item to promote fast uncoupling for avoiding accidental catching where the first port and the second port are high-heat stable. And another embodiment is the technology coupler for anchoring a tube in a body-worn item to promote fast uncoupling for avoiding accidental catching where the first port and the second port include food grade plastic material. And yet an additional embodiment is the technology coupler for anchoring a tube in a body-worn item to promote fast uncoupling for avoiding accidental catching further including an affixing mechanism including a magnet, a hook and loop fastener, a button, a button hole, and/or an eyelet.

A third general aspect of the present invention includes a technology coupler for anchoring a tube in a body-worn item to avoid strangulation, the technology coupler including: a first port that is configured to releasably couple to a first tube to the technology coupler without fluid leaking; a second tube, where the first port is in fluid communication with the second tube; and an anchor, where: the anchor is affixed to a body-worn item; the anchor holds the first port at a location proximate to the body-worn item; and the anchor is affixed in a concealed location of the body-worn item such that at least one of the first tube or second tube passes into the body-worn item to mate with its respective port.

Further embodiments of the present aspect may include one or more of the following features. An additional embodiment is the technology coupler for anchoring a tube in a body-worn item to avoid strangulation further including a second port configured to releasably couple to the second tube. A further embodiment is the technology coupler for anchoring a tube in a body-worn item to avoid strangulation where the anchor is affixed to the body-worn item removably or non-removably. Another embodiment of is the technology coupler for anchoring a tube in a body-worn item to avoid strangulation where the first port is high heat stable. The technology coupler for anchoring a tube in a body-worn item to avoid strangulation where the first port includes food grade plastic material. And yet an additional embodiment is the technology coupler for anchoring a tube in a body-worn item to avoid strangulation further including an affixing mechanism including a magnet, a hook and loop fastener, a button, a button hole, and/or an eyelet.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures:

FIG. 9D depicts a releasable coupler with attachment hoop affixed there to.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

In the appended figures, similar components and/or features may have the same reference label. Where the reference label is used in the specification, the description is applicable to any one of the similar components having the same reference label.

DETAILED DESCRIPTION OF THE INVENTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment. It is understood that various changes may be made in the function and arrangement of elements without departing from the spirit and scope as set forth in the appended claims.

Technology devices may be concealed in and outside of conduit's in clothing and accessories. To that end, described herein, are releasable coupler's and tube assemblies that can be affixed to clothing and other accessories for safe concealment of technology devices and accessories and to avoid strangulation and other accidental harm should an accessory get snagged, caught, or pulled. The releasable coupler and releasable tube assemblies will "break-away" from each other or the component or accessory they are attached to when undo pressure is applied. The integration of the releasable coupler and the releasable tube assembly allow one to imbibe inconspicuously and safely. The releasable coupler and releasable tube assemblies also allow for easy removal for cleaning and maintenance purposes.

Figure 1:
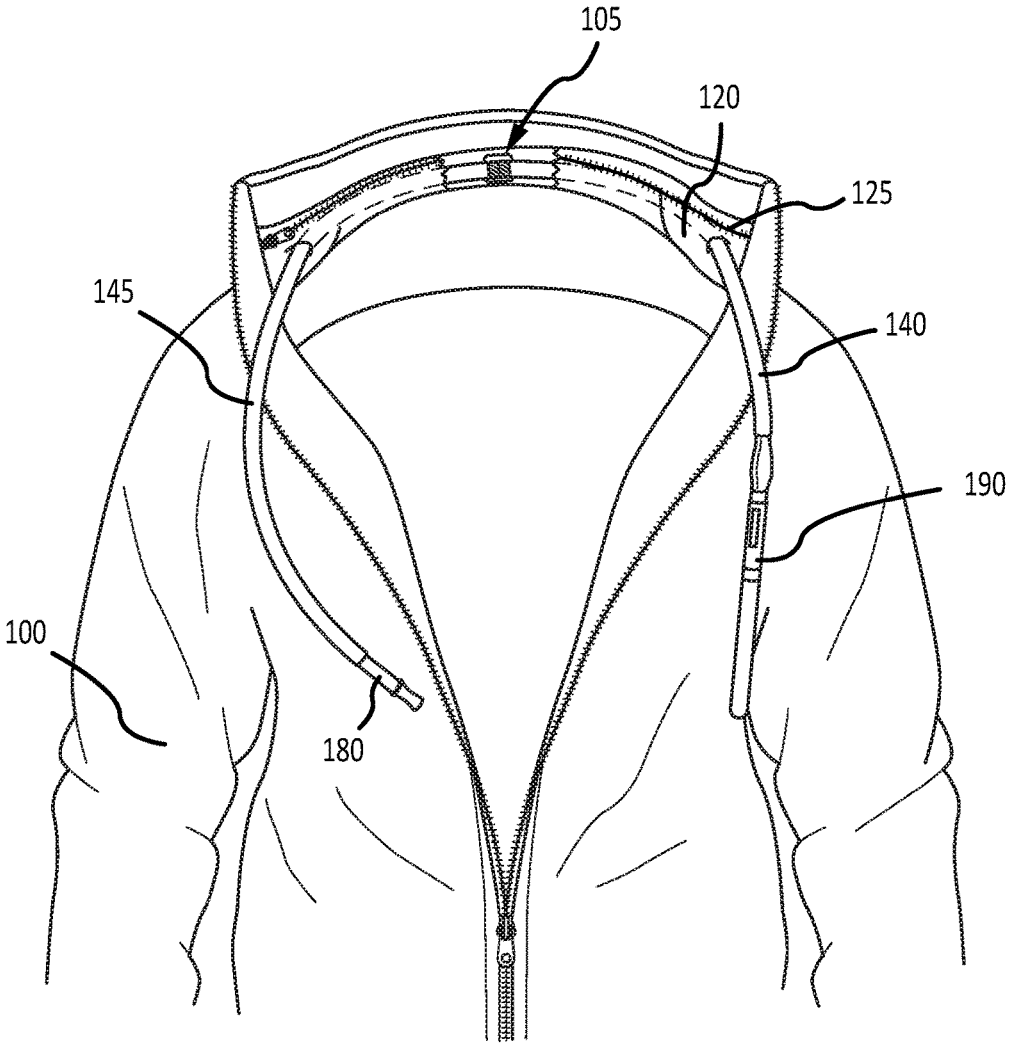
FIG. 1 depicts a releasable coupler in a hoodless garment.

Referring now to FIG. 1, that depicts a releasable coupler in a hoodless body-worn item 100 in a manner to prevent strangulation. Hoodless body-worn item 100 comprises a conduit 120 in the collar of the hoodless body-worn item 100. The conduit has a closure 125 that partially encloses a first tube 140 and a second tube 145. On one end of tube 140 is an technology tank 190. The other end of tube 140 is coupled with releasable coupler 105. Releasable coupler 105 is also coupled to one end of tube 145, allowing for fluid communication between tube 140 and tube 145. The other end of tube 145 is connected to mouthpiece 180.

Releasable coupler 105 is described in detail in FIGS. 6, 7, 8, and 9 and shown in FIG. 1 as a cut-away to expose it.

Releasable coupler 105 releases the tube 140 and/and or the tube 145 if too much pressure is applied to one or more of them to prevent strangulation, catching, an snagging. Releasable coupler 105 also facilitates easy decoupling for cleaning and maintaining tube 140 and 145. Hoodless body-worn item 100 could be any body-worn item with a collar or neckline allowing for tube 140 and the tube 145 to surround the neckline area. Hoodless body-worn item 100 may be open in front as shown or may closed in front. Hoodless body-worn item 100 may be made of any type of fabric or material safe for human to wear including cotton, silk, polyester, nylon, fleece, denim, flannel, Gore-Tex, etc. Tube 140 may comprise flexible material that is safe for passing fluids to be consumed by humans. Tube 140 may comprise material that is high-heat safe.

Tube 140 may be from half the length of the neck area to more than twice the length of the neck area. The tube 140 circumference may be sized to fit technology tank 190. The tube 140 circumference is also sized to fit releasable coupler 105, but does not necessarily have to have uniform circumference along its length. Tube 140 may be clear or opaque or semi-opaque. Tube 140 may be covered with a cloth covering to make it appear like a drawstring or other body-worn accessory. Tube 145 may comprise flexible material that is safe for passing fluids to be consumed by humans. Tube 145 may comprise material that is high-heat safe. Tube 145 may be from half the length of the neck area to more than twice the length of the neck area. The tube 145 circumference may be sized to mouthpiece 180. The tube 145 circumference is also sized to fit releasable coupler 105, but does not necessarily have to have uniform circumference along its length. Tube 145 may be clear or opaque or semi-opaque. Tube 145 may be covered with a cloth covering to make it appear like a drawstring or other body-worn accessory.

Mouthpiece 180 may be made of a rigid material safe to pass fluids to humans. Mouthpiece 180 may be high-heat capable. Mouthpiece 180 may be connected to tube 145 directly. Mouthpiece 180 is configured to pass fluid from the first tube 145, that may be connected to the first technology tank 190 through tube 140. Mouthpiece 180 may operate to draw fluid through tube 140 from the first technology tank 190 to tube 145 when a user sucks on the mouthpiece 180. Technology tank 190 may be configures to be an oxygen canister, an oxygen generator, a vapor pen, a nebulizer, a liquid bladder, an air filter, and/or other liquid, smoke, vapor, or gas supplying technology. The technology tank 190 may be made of rigid or semi-rigid material safe to hold human consumable fluids such as plastic, stainless steel, rubber, or other suitable material. The technology tank 190 may be high heat capable and capable of generating steam or vapor. The technology tank 190 may supply fluid to first tube 140, including fluid in any form comprising liquid, gas, and vapor. First technology tank 190 may be powered and operate with a power supplying device such as a battery. Technology tank 190 may be sized to be inconspicuous.

Conduit 120 may extend along the neckline of the body-worn item 100. Conduit 120 may be made of the same material as the hoodless body-worn item 100 or may be comprised of an insulating material or a material designed for neck comfort. The length of conduit 120 is variable but may be as long as the neckline or much shorter at a minimum length to conceal the releasable coupler 105. Conduit 120 may be slightly larger than the tube diameter in width, or much larger and may also accommodate other technology such as headphones. Conduit 120 has a closure 125. Closure 125 may comprise a zipper, a hook and loop fastener, buttons, snaps, or any other closure mechanism suitable for the neckline. Conduit 120 may run along the outer edge of the collar or neckline on the hoodless body-worn item 100, or may be located lower than the edge.

Figure 2:
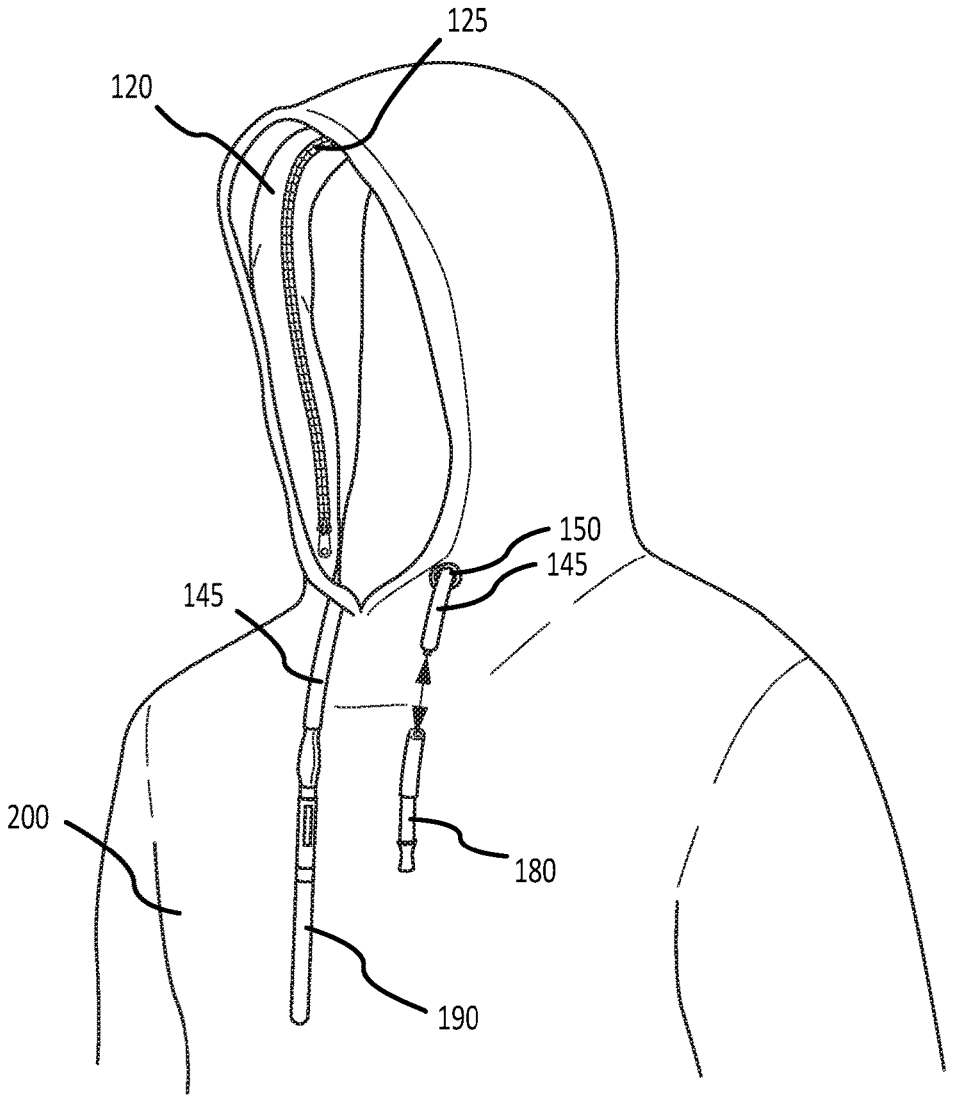
FIG. 2 depicts a releasing tube mechanism in a hooded garment.

Referring next to FIG. 2, the hooded body-worn item 200 comprising a releasable tubing system formed when mouthpiece 180 is connected to tube 145 to act to prevent strangulation, and accidents caused by catching and snagging. Tube 145 enters the hood portion of the hooded body-worn item through a portal 150 and through conduit 120. Conduit 120 includes a closure 125. Tube 145 exits the conduit on the opposite side of the hood it entered and couples with technology tank 190. The releasable tubing system is discussed in more detail at FIG. 10, but provides a strangulation free use of the hooded body worn item 200 in the present configuration and could be located on tube 145 at any point from the mouthpiece 180 to the technology tank 190. Mouthpiece 180 and technology tank 190 are more thoroughly described in FIG. 1. Portal 150 as depicted is circular but may be tear shaped or any other shape facilitating passage of the tube 145. Portal 150 may be reinforced with stitching but may also be reinforced with metal, plastic, fabric, or any other suitable material.

Tube 145 may comprise flexible material that is safe for passing fluids to be consumed by humans. Tube 145 may comprise material that is high-heat safe. Tube 145 is at least the length of the hood on the hooded body-worn item 200, and may be up to 20 inches longer. The tube 145 circumference may be sized to mouthpiece 180. The tube 145 circumference is also sized to technology tank 190, but does not necessarily have to have uniform circumference along its length. Tube 145 may be clear or opaque or semi-opaque. Tube 145 may be covered with a cloth covering to make it appear like a drawstring or other body-worn accessory. Tube 145 may be flexible to act as a drawstring for the hood of the hooded body worn device.

Conduit 120 may extend along the face of the hood of the hooded body-worn item 200. Conduit 120 may be made of the same material as the hooded body-worn item 200 or may be comprised of an insulating material or a material designed for neck comfort. The length of conduit 120 is variable but may be as long as the hood of the hooded body-worn item 200. Conduit 120 may be slightly larger than the tube diameter in width, or much larger and may also accommodate other technology such as headphones. Conduit 120 has a closure 125. Closure 125 may comprise a zipper, a hook and loop fastener, buttons, snaps, or any other closure mechanism suitable for the neckline. Conduit 120 may sit away from the edge of the hood of the hooded body-worn item 200 by as much as one to two inches.

Figure 3:
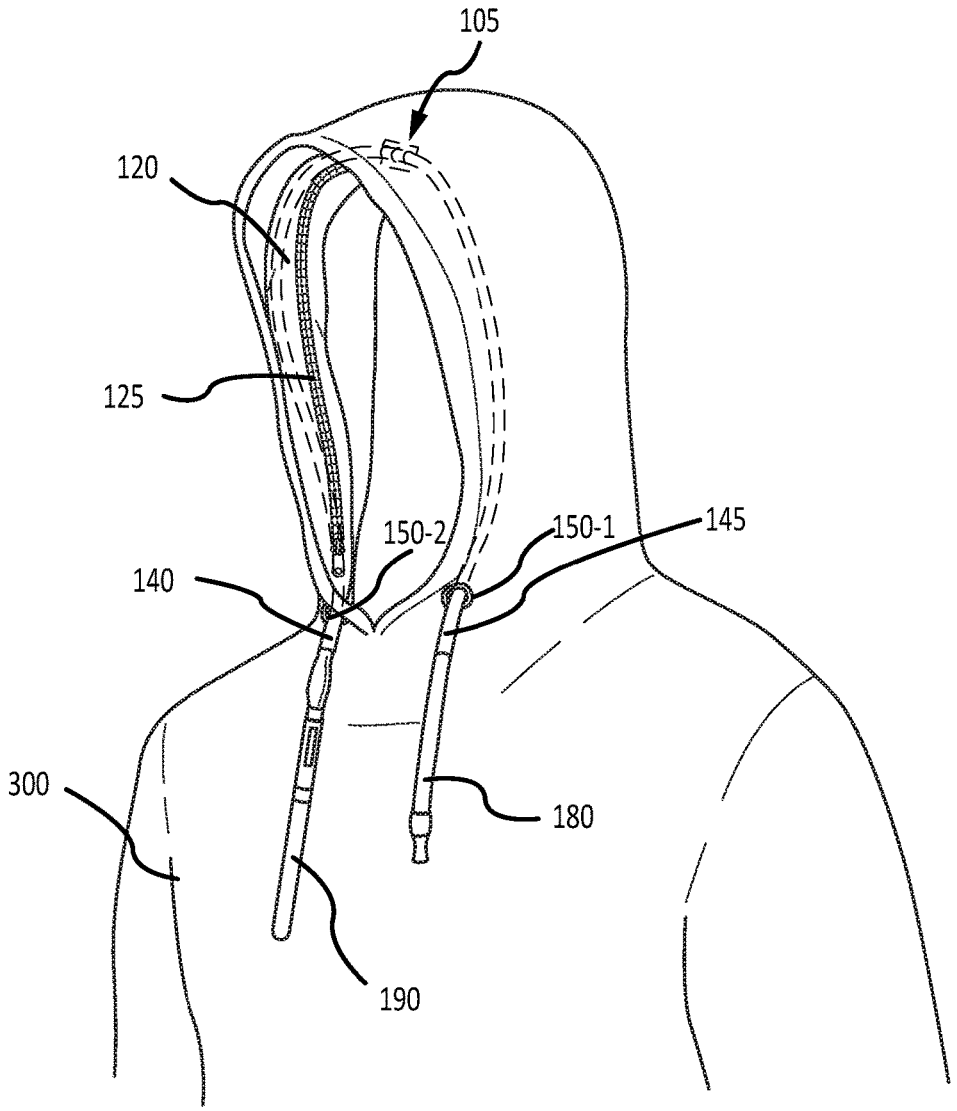
FIG. 3 depicts a releasable coupler in a hooded garment.

Referring next to FIG. 3, depicting a releasable coupler 105 in the hood of a hooded body-worn item 300. Mouthpiece 180 is connected to tube 145. Tube 145 enters portal 150-1, the opening to conduit 120 with closure 125. Tube 145 is coupled with releasable coupler 105 in the conduit 120. Releasable coupler 105 is also coupled with tube 140 in the conduit 120 to allow fluid communication between tube 145 and tube 140. Tube 145 exits thru portal 150-2 and is coupled to technology tank 190. Releasable coupler 105 can be in the middle of the conduit or at an part of the conduit from portal 150-1 to portal 150-2. If pressure is applied to tube 140 or 145, releasable coupler 105 will allow the tube 140 and/or the tube 145 to break-way from the other tube to prevent strangulation, or accidents caused by catching and snagging. Releasable coupler 105 also makes it easy to decouple tube 140 and tube 145 for cleaning and maintenance. Further features of the conduit 120, the closure 125, the tube 140, the tube 145, the portal 150, the mouthpiece 180 and the technology chamber 190 are more thoroughly discussed in FIGS. 1 and 2 and share the same features for hooded body-worn item 300.

Figure 4:
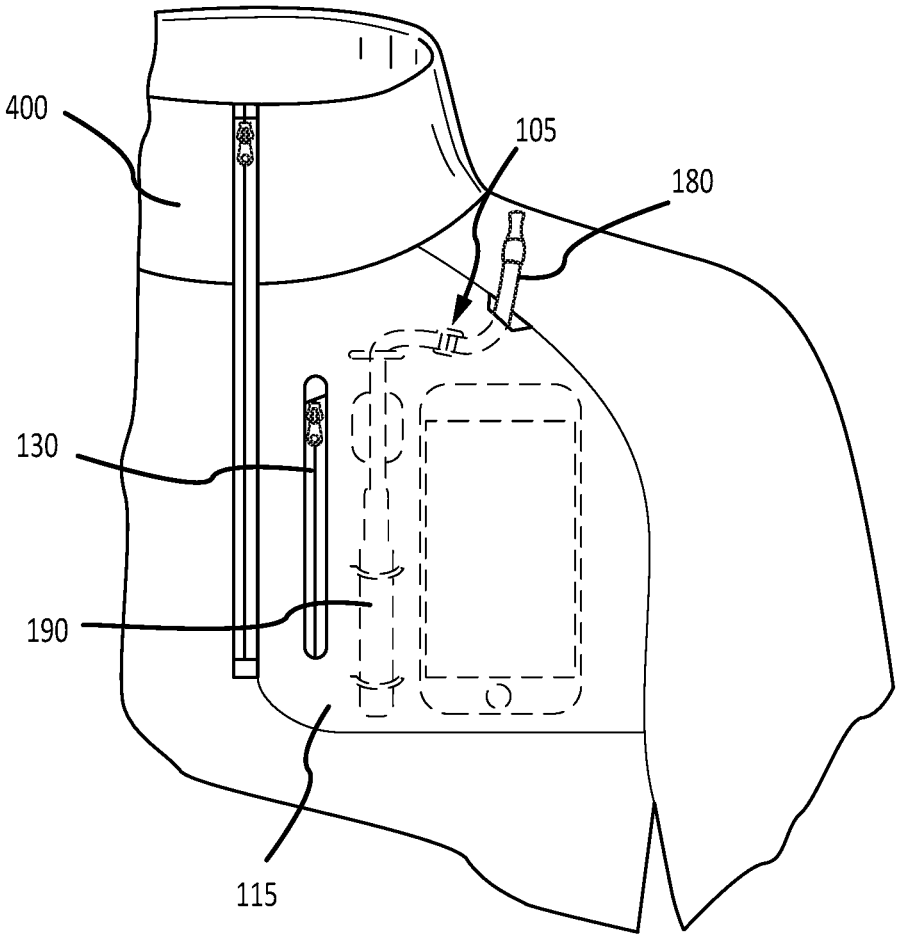
FIG. 4 depicts a releasable coupler in a technology chamber of a garment.

Referring now to FIG. 4, depicting a body-worn item 400. Body-worn item 400 comprises a technology chamber 115 with closure 130. Technology chamber 115 holds a technology tank 190. Technology tank 190 is connect to a releasable coupler 105 and is in fluid communication with mouthpiece 180 that is also coupled with the releasable coupler 105. Mouthpiece 180 exits the technology chamber through an opening, but could also exit through portal 150 (not shown). Releasable coupler 105 will release the mouthpiece 180 and/or the technology tank 190 when pressure is applied to prevent accidents caused by snagging and grabbing as well as to all for easy cleaning and maintenance of the mouthpiece 180 and the technology tank 190. Technology chamber 115 may be sized to hold one or more technology tanks 190 as well as other associated technology or personal technology such as cell phones, smart phones or GPS devices. Technology chamber 115 may comprise the same fabrics of the body-worn item 400 or may have insulating material or may be a completely different fabric, including a waterproof fabric. Technology chamber 115 is sized to fit technology tank 190 but may also be sized to fit additional technology and other items. Technology chamber 115 is shown on the right-hand side of body-worn item 400—but may also be placed on the left-hand side or any other portion of the body-worn item 400 conducive to functionality. Closure 130 may comprise a zipper, a hook and loop fastener, buttons, snaps, or any other closure mechanism. Closure 130 may extend the entire longitudinal dimension of the technology chamber 115, or any portion thereof, or may extend the entire latitudinal dimension or any portion thereof. Closure 130 is sized to allow technology tank 190 to be placed in technology chamber 115. Further features including the mouthpiece 180 and the technology chamber 190 are more thoroughly discussed in FIGS. 1 and 2 and share the same features as body-worn item 400.

Figure 5:
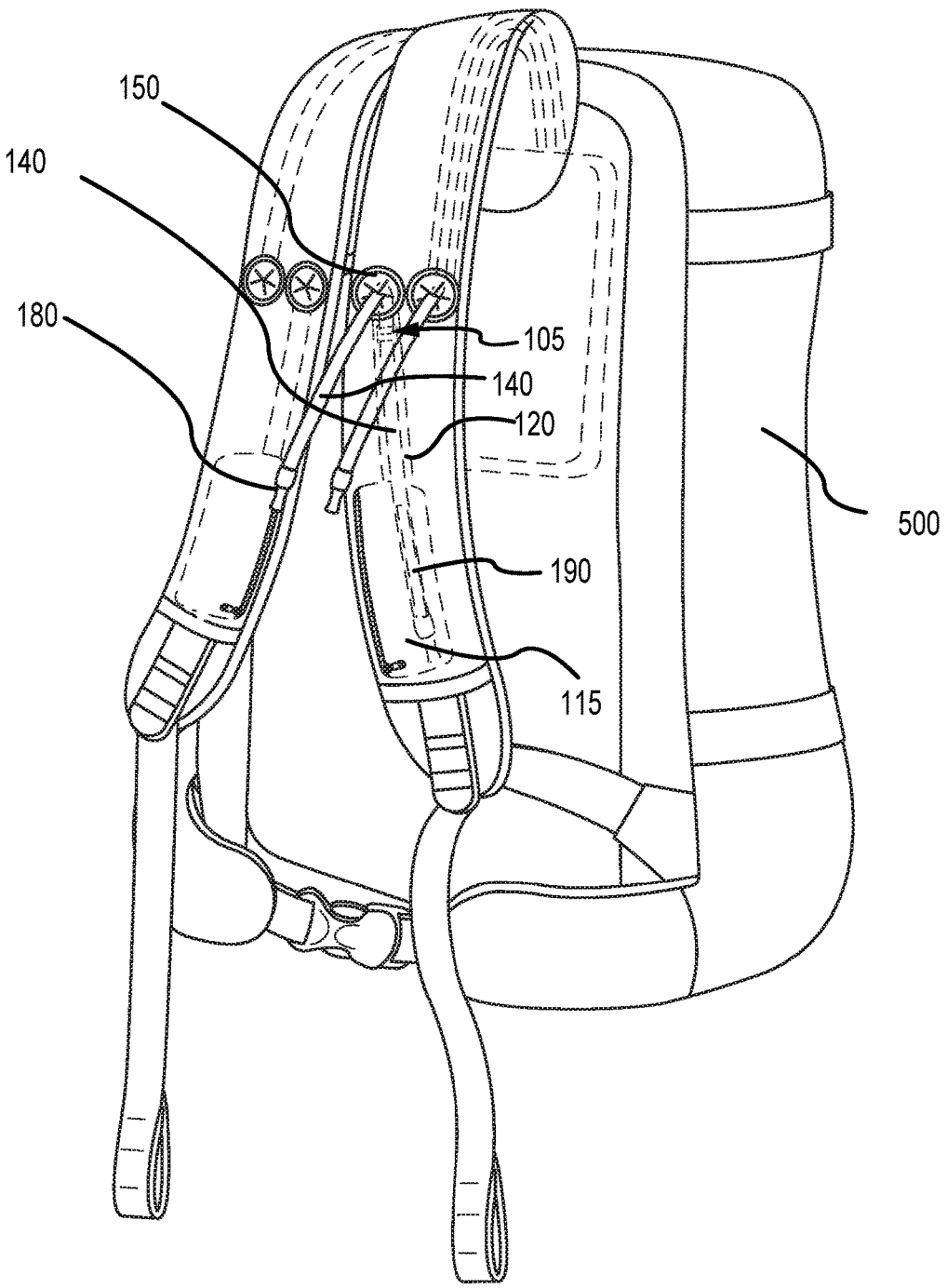
FIG. 5 depicts a releasable coupler in a technology backpack.

Referring next to FIG. 5, a technology backpack 500 with releasable coupler 105. Releasable coupler 105 couples a mouthpiece 180 to tube 140. Tube 140 enters technology chamber 115 thru portal 150 after traveling through conduit 120. Tube 140 is coupled to technology tank 190 in the technology chamber 115. Releasable coupler 105 causes tube 140 to break away from technology tank 190 when pressure is applied to mouthpiece 180 to prevent accidents caused by snagging or catching mouthpiece 180. Further features of the technology chamber 115, the conduit 120, the tube 140, the portal 150, the mouthpiece 180 and the technology tank 190 have been thoroughly covered in previous figures and share the same features as technology backpack 500.

Figure 6:
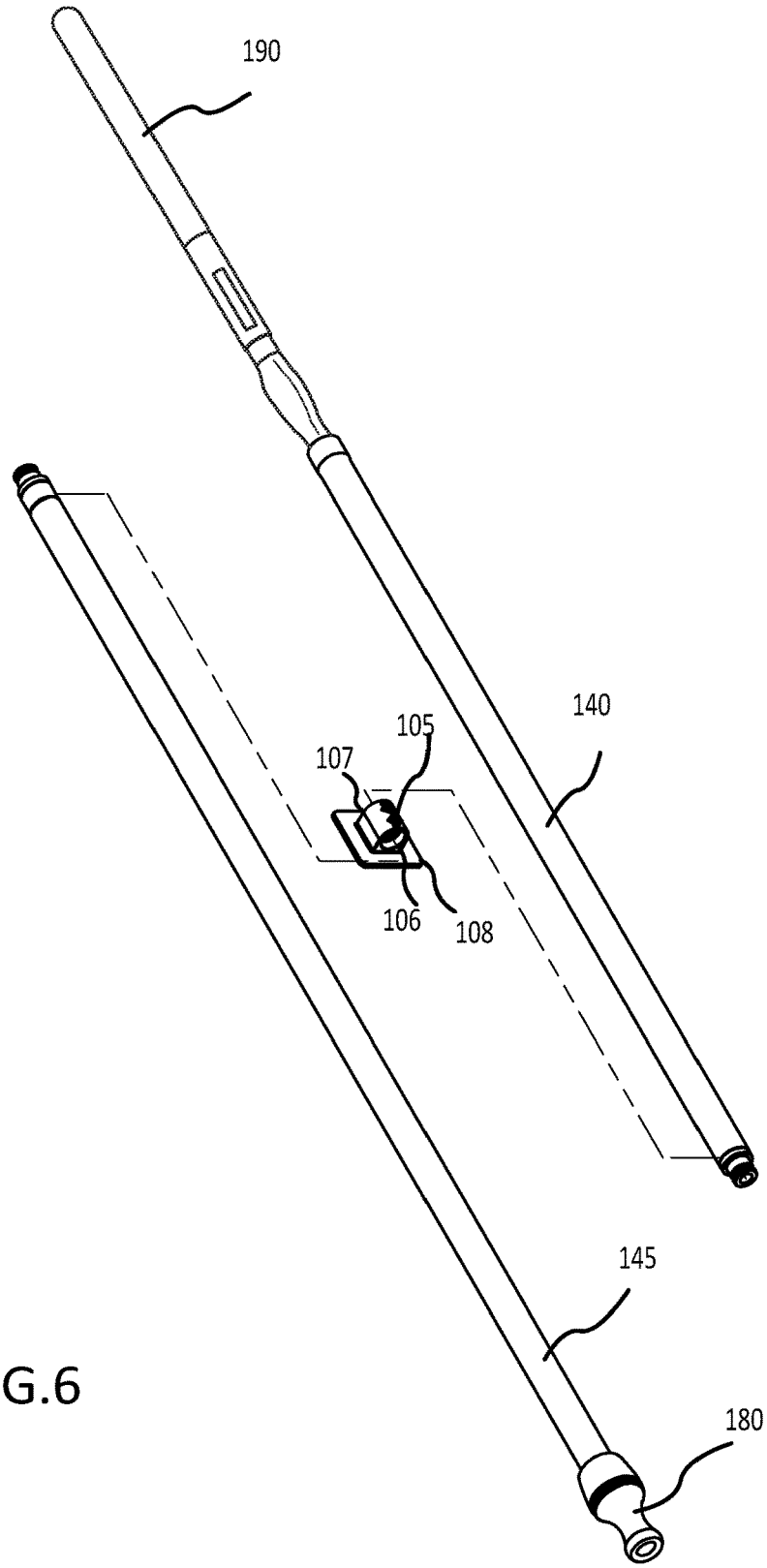
FIG. 6 depicts a releasable coupler with tubes, mouthpiece, and technology tank.

Referring next to FIG. 6, a releasable coupler 105 with tubes 140 and 145, mouthpiece 180, and technology tank 190 are shown. Mouthpiece 180 is connected to tube 145. Tube 145 ends with a releasable connection shown to fit in a first port 106 of a releasable coupler 105. Tube 140 is connected at one end to a technology tank 190 and shown to be connected on the other end to second port 107 of the releasable coupler 105 so that it will be in fluid connection with tube 145. Releasable coupler 105 comprises two ports 106 and 107, and an anchor 108 that holds the releasable coupler 105 and the ports 106 and 107 in place. Mouthpiece 180, tube 145, tube 140 and technology chamber 190 have been described more thoroughly in the previous figures. Anchor 108 is more thoroughly described in FIGS. 7, 8, and 9.

Releasable coupler 105 may be rigid or semi rigid. Releasable coupler 105 may be high heat capable and capable of being ordinarily laundered if permanently attached to a body-worn item. Releasable coupler 105 may be comprised of material approved for storing food product so that is safe to pass fluids to humans. Releasable coupler 105 must be able to fluidly connect tubes 140 and 145 without leaking liquid, gas, or vapor. Releasable coupler 105 may come in various sizes to accommodate various sized tubes 140 and 145. It may be as small as an eighth of an inch and as large as 2 inches in some embodiments, but can be not be smaller than the diameter of tubes 140 and 145. Releasable coupler 105 is shown here connected to tubes 140 and 145, but may be directly connect to technology tank 190 and/or mouthpiece 180 in some embodiments.

Releasable coupler 105 is shown here with port 106 and 107. Ports 106 and/or 107 can operate releasable in various embodiments. In some embodiments either port 106 or 107 will be non-releasably attached to tube 140 or 145. In some embodiments either port 106 or ports 107 will be permanently attached to tube 140 or 145. Ports 106 and 107 may be comprised of material approved for storing food product so that is safe to pass fluids to humans, and may be high heat capable and capable of being ordinarily laundered if permanently attached to a body-worn item. Ports 106 and 107 must be able to fluidly connect tubes 140 and 145 without leaking liquid, gas, or vapor. Ports 106 and 107 may be rigid or semi-rigid and sized to fit tubes 140 and 145. Ports 106 and ports 107 may be sized the same but may be sized differently. Ports 106 and 107 may be sized to directly connect to the mouthpiece 180 or the technology tank 190.

Figure 7A:
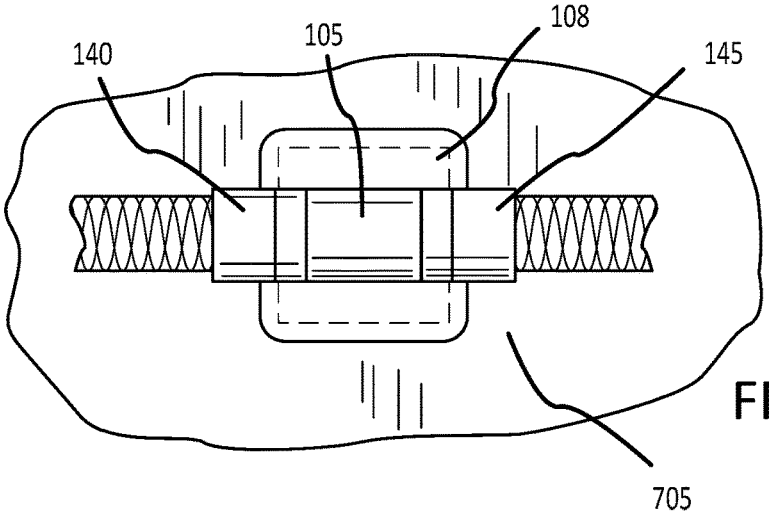
FIG. 7A depicts a releasable coupler coupled to two tubes.
Figure 7B:
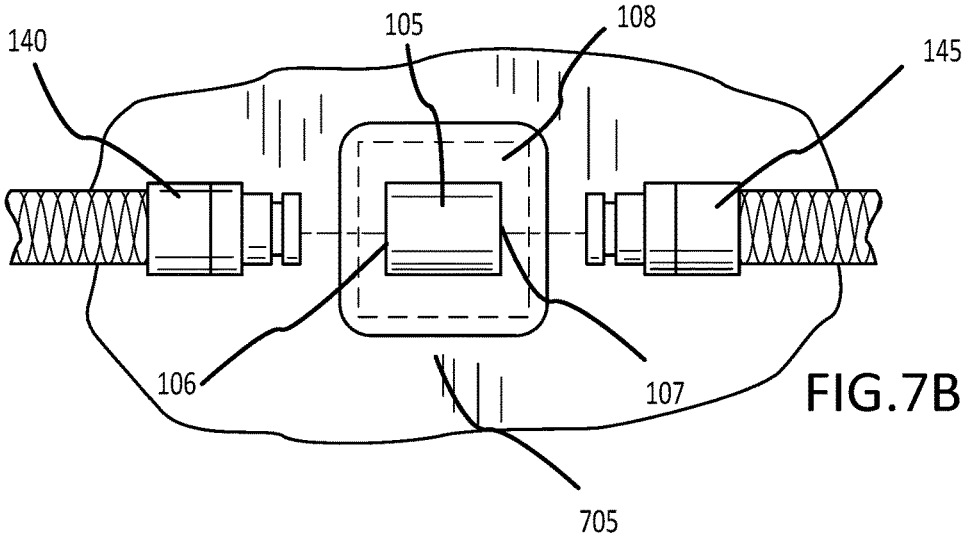
FIG. 7B depicts a releasable coupler with both tubes disconnected.
Figure 7C:
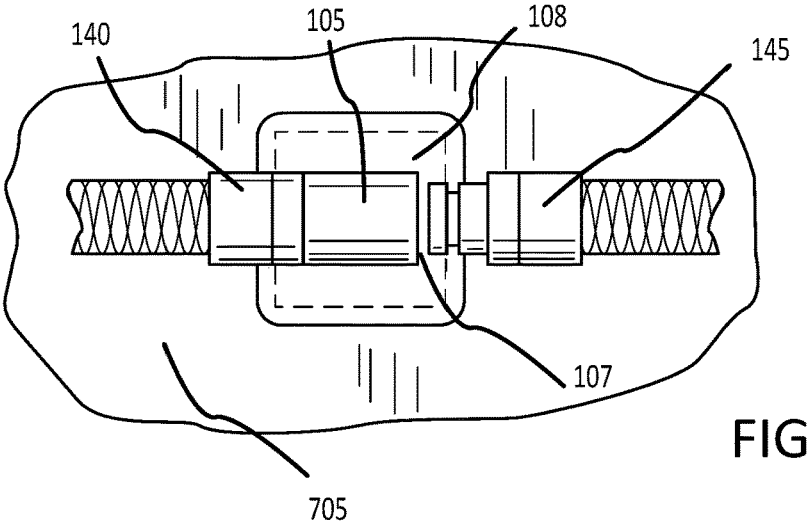
FIG. 7C depicts a releasable coupler with one tube connected and one tube disconnected.

Referring next to FIGS. 7A-7C, a frontal view of releasable coupler 105 attached by anchor 108 that may be stitched to material 705. FIG. 7A shows both tubes 140 and 145 in fluid connection with releasable coupler 105. FIG. 7B shows tubes 140 and 145 both disconnected to from releasable coupler 105 and where ports 106 and 107 are shown. FIG. 7C shows releasable coupler 105 with tube 140 coupled to it and tube 145 disconnected from it with port 107 viewable. Aspects of releasable coupler 105, ports 106 and 107, and tubes 140 and 145 have been described in detail in previous figures. In these figures tubes 140 and 145 are shown encased in a fabric like material. Material 705 may be material of a body-worn item, a bag such as backpack, over-the-shoulder bag, purse, knapsack, or any other carrying device.

Figure 8A:
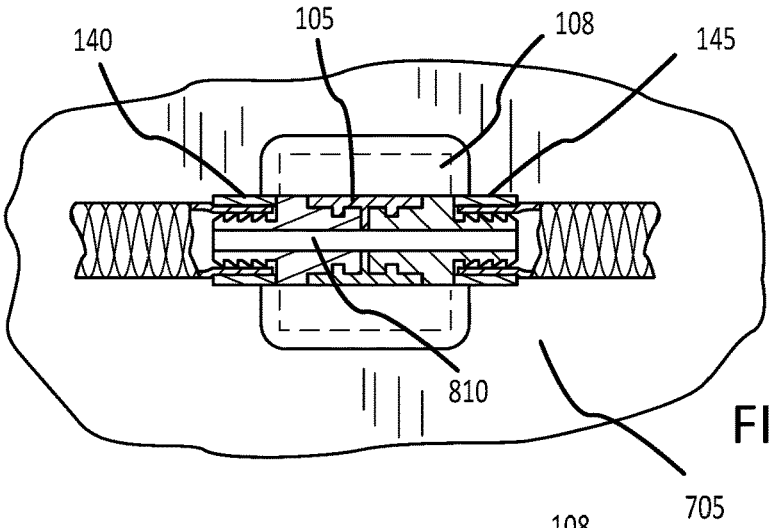
FIG. 8A is a cutaway view of a releasable coupler coupled to two tubes.
Figure 8B:
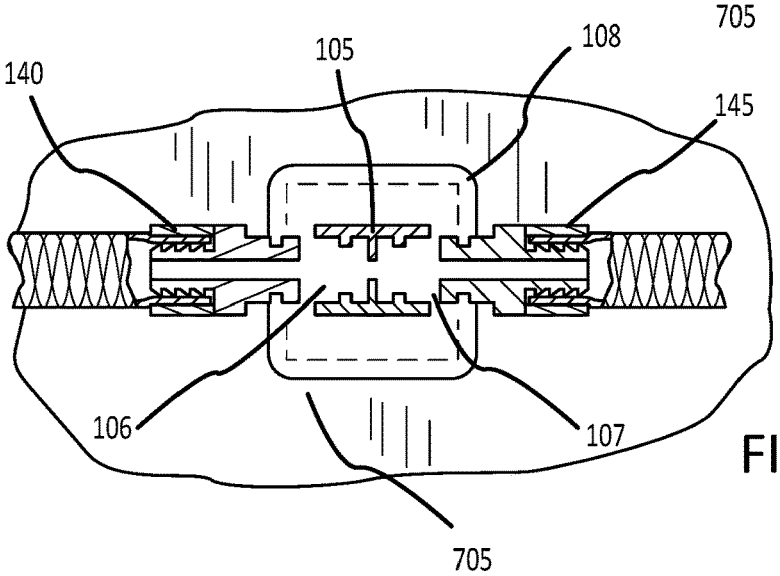
FIG. 8B is a cutaway view of releasable coupler with both tubes disconnected
Figure 8C:
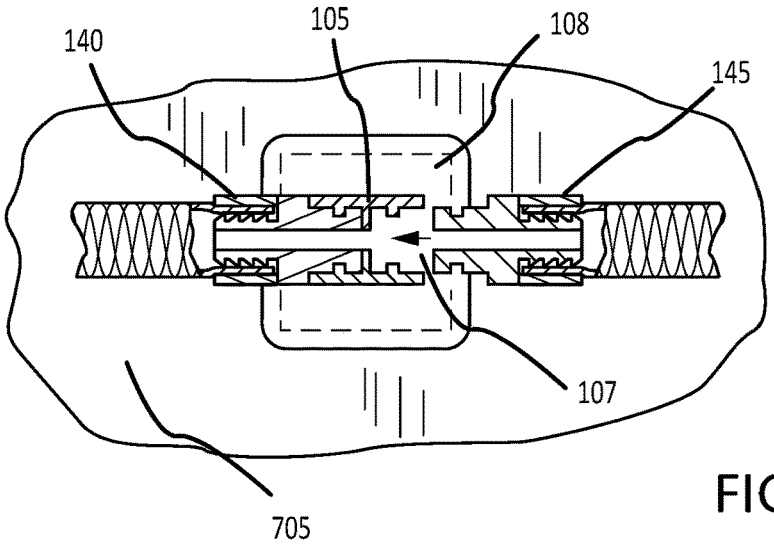
FIG. 8C is a cutaway view of a releasable coupler with one tube connected and one tube disconnected

Referring next to FIGS. 8A-8C, cut-away views of releasable coupler 105 attached to anchor 108 that may be stitched to material 705. FIG. 8A is a view of both tubes 140 and 145 in fluid connection with the releasable coupler 105. In this view the fluid connection 810 is shown. FIG. 8B shows that tubes 140 and 145 are both disconnected from releasable coupler 105. FIG. 8C shows tube 140 coupled to releasable coupler 105 and tube 145 disconnected. In FIGS. 8A-8C, the releasable features of the releasable coupler 105 are shown in the interior indentions in releasable coupler 105 that holds tubes 140 and 145 in a releasable manner. While a particular releasable coupler structure is shown in these figures, the invention is not so limited and contemplates the use of any releasable structure appropriate for releasable coupler 105.

Figure 9A:
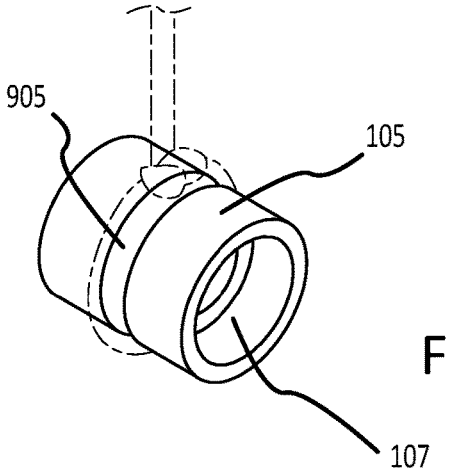
FIG. 9A depicts a releasable coupler with an affixing groove.

Referring next to FIG. 9A, showing the releasable coupler 105 with port 107 showing a groove 905 centered on the releasable coupler 105 so as to allow the releasable coupler 105 to be looped around the groove 905 to be affixed to an item. For instance, thread, string, wire, or an elastic loop could be used to affix the releasable coupler 105 to a body-worn or other item. For example—it could be looped around a label in a body-worn item such as shirt or jacket or attached to any hook or loop on a backpack. In this embodiment the releasable coupler 105 is readily removable and can be transferred to any body-worn or other item.

Figure 9B:
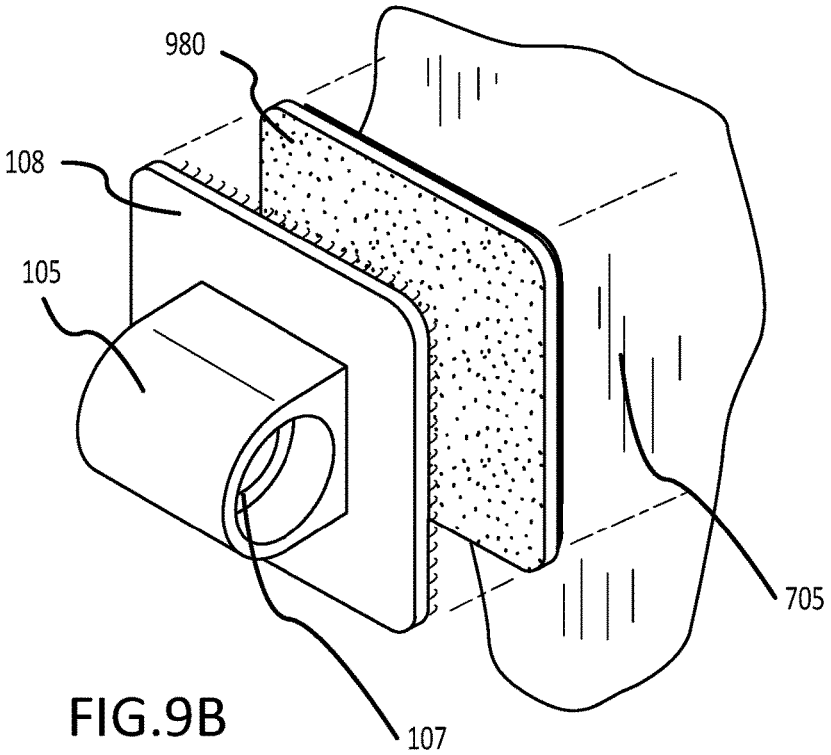
FIG. 9B depicts a releasable coupler affixed with a hook and loop mechanism.

Referring next to FIG. 9B, the releasable coupler 105 with anchor 108 attached to a hook type fastener with port 107 showing. The loop side 980 of the hook and loop fastener is shown in proximity to material 705. The loop side 980 is mean to be affixed to material 705. The loop side 980 can be affixed by sewing it to material 705, or by any other appropriate manner including peel and stick adhesive. In many cases the loop side 980 will be affixed permanently and will be laundry capable. Loop side 980 is the comfortable side of a hook and loop type fastener system so will not interfere or be uncomfortable or snag when wearing on a body-worn item without the anchor 108 attached to the hook side. The releasable coupler 105 in this configuration is removable and portable and can be attached to any item with loop side connection.

Figure 9C:
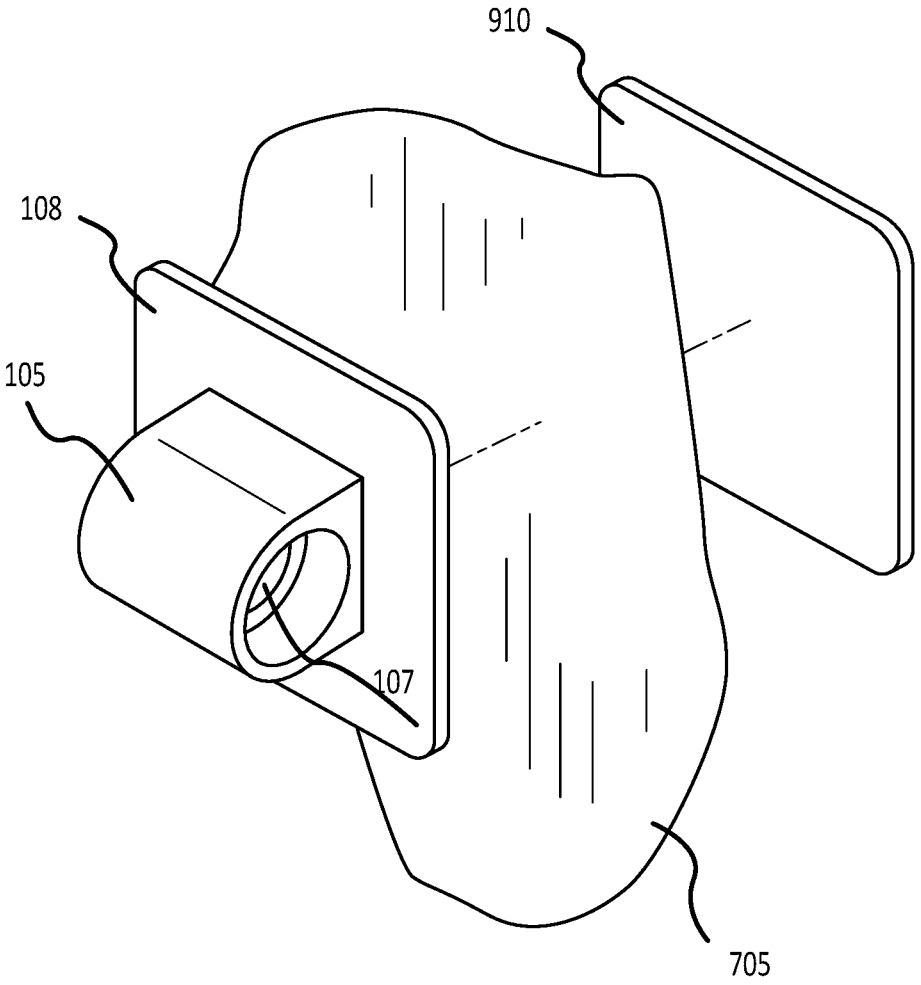
FIG. 9C depicts releasable coupler affixed to a magnet portion

Referring next to FIG. 9C, showing a releasable coupler 105 attached to an anchor 108 that is magnetic capable. Port 107 is shown in this particular view. Material 705 is shown proximate to anchor 108 and magnet 910. When the magnet is applied to the anchor 108 that is magnetic capable, the releasable coupler 105 will be firmly affixed to material 705. The releasable coupler 105 in this configuration can be used with any item and is completely removable and portable.

Figure 9D:
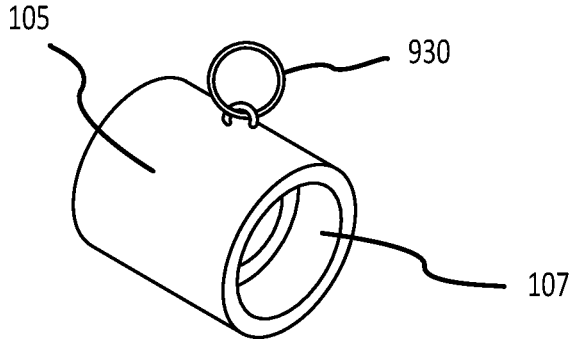

Referring next to FIG. 9D, showing a releasable coupler 105 with port 107 visible and attached to a ring assembly 930. Ring assembly 930 could be the same material as releasable coupler 105 or could be plastic, metal, or other suitable material to be used to affix releasable coupler 105 to an item. In this particular embodiment, for instance, releasable coupler 105 may be connected to a backpack or other item with a c-clamp or any other mechanism for connecting a ring.

Figure 9E:
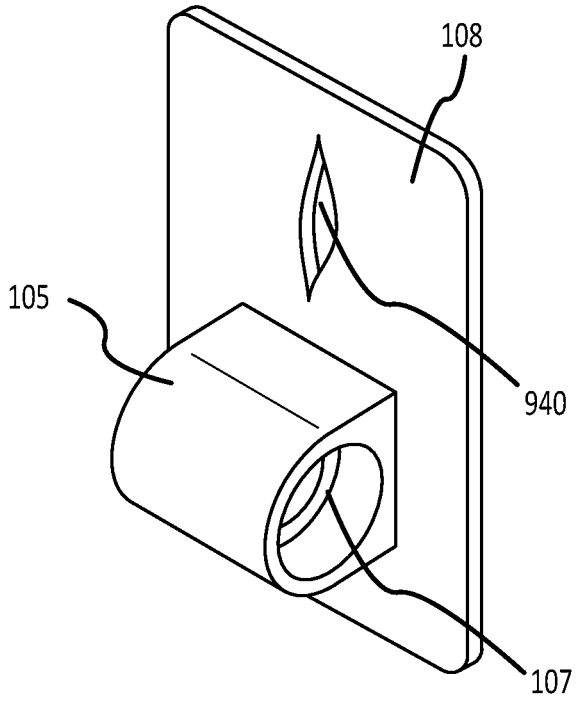
FIG. 9E depicts a releasable coupler with buttonhole type attachment mechanism.

Referring next to FIG. 9E, showing a releasable coupler 105 attached to anchor 108 with port 107 visible. Anchor 108 has a buttonhole 940. Buttonhole 940 allows the releasable coupler 105 to be affixed to an item by any button or button like mechanism. The releasable coupler 105 is removable and portable from item to item. While a buttonhole 940 configuration is shown here, one of skill in the art will recognize that anchor 108 could comprise a button or button like mechanism rather than a buttonhole and would likewise provide flexibility and portability to the releasable coupler 105.

Described herein are various ways to affix releasable coupler 105 to an item, but the invention is not so limited to those described. Any method used to affix releasable coupler 105 to an item or device is contemplated by the present invention.

Figure 10A:
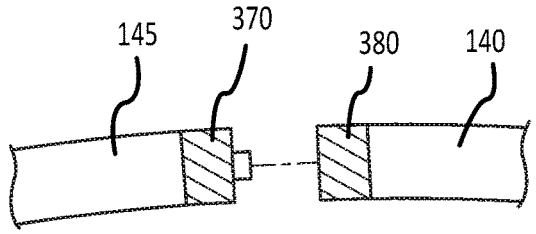
FIG. 10A depicts a releasable tube assembly.

Referring next to FIG. 10A, a releasable tubing assembly 1005, comprising tube 145 connected to male connector 370 in proximity with female connector 380 connected to tube 140. In normal operation of releasable tubing assembly 1005, tubes 145 and 140 will be in releasable connection in such a manner as not to leak. When either tube 140 or 145 are pulled, the male connector 370 will disconnect form the female connector 380 to break away tube 140 from 145 to avoid strangulation or accidents caused by pulling or snagging either tube 140 or 145. Male connector 370 and female connector 380 may be threads, friction and/or magnets to hold together tubes 140 and 145. It is contemplated as described previously that that either tube 140 or tube 145 may be connected to a technology tank 190 or a mouthpiece 180.

Male connector 370 may be rigid or semi-rigid. Male connector 370 may be high heat capable and capable of being ordinarily laundered if permanently attached to a body-worn item. Male connector 370 may be comprised of material approved for storing food product so that is safe to pass fluids to humans. Male connector 370 must be able to fluidly connect tubes 140 to 145 without leaking liquid, gas, or vapor. Male connector 370 may come in various sizes to accommodate various sized tube 145. It may be as small as an eight of an inch and as large as 2 inches in some embodiments, but can be not be smaller than the diameter of tube 145. Male connector 370 is shown here connected to tubes 145, but may be directly connect to technology tank 190 and/or mouthpiece 180 in some embodiments.

Female connector 380 may be rigid or semi-rigid. Female connector 380 may be high heat capable and capable of being ordinarily laundered if permanently attached to a body-worn item. Female connector 380 may be comprised of material approved for storing food product so that is safe to pass fluids to humans. Female connector 380 must be able to fluidly connect tubes 140 to 145 without leaking liquid, gas, or vapor. Female connector 380 may come in various sizes to accommodate various sized tube 140. It may be as small as an eighth of an inch and as large as 2 inches in some embodiments, but can be not be smaller than the diameter of tubes 140. Female connector 370 is shown here connected to tube 140, but may be directly connect to technology tank 190 and/or mouthpiece 180 in some embodiments.

Figure 10B:
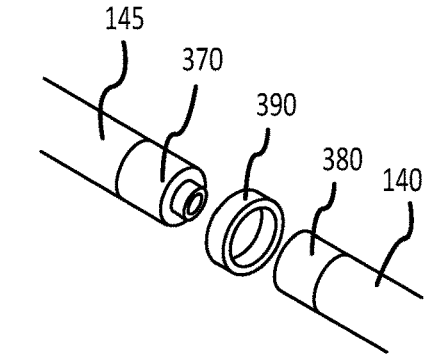
FIG. 10B depicts a releasable tube assembly with joining washer from a front perspective with the tubes disjoined.

Referring next to FIG. 10B, releasable tube assembly 1010 with washer connector 390 is shown in front perspective. Washer connector 390 is a single port connector device as shown. Washer connector 390 maybe magnetic, plastic, metal or any other appropriate device to provide a structural layer for male connector 370 and female connector 380 when connected. Washer connector 390 may be rigid or semi-rigid. Washer connector 390 may be high heat capable and capable of being ordinarily laundered if permanently attached to a body-worn item. Washer connector 390 may be comprised of material approved for storing food product so that is safe to pass fluids to humans. Washer connector 390 must be able to fluidly connect male connector 370 with female connector 380 without leaking liquid, gas, or vapor. Washer connector 390 may come in various sizes to accommodate various sized male connectors 370 and female connectors 380. It may be as small as an eighth of an inch and as large as 2 inches in some embodiments, but can be not be smaller than the diameter of male connector 370 and female connector 380. Tube 140 is coupled to female connector 380 and tube 145 is coupled to male connector 370 in this view.

Figure 10C:
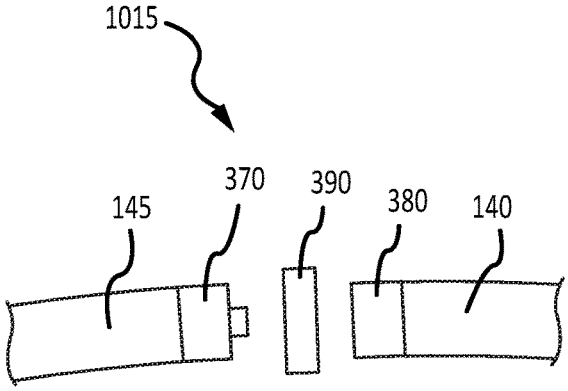
FIG. 10C depicts a releasable tube assembly with joining washer from a side view with the tubes disjoined.

Referring next to FIG. 10C, the releasable tube assembly 1015 with washer connector 390 is shown from a side view with male connector 370 disconnected from female connector 380. Tube 140 is coupled to female connector 380 and tube 145 is coupled to male connector 370 in this view.

Figure 10D:
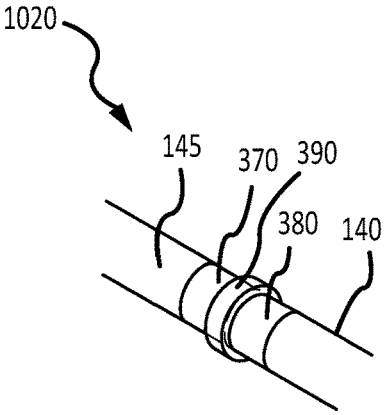
FIG. 10D depicts a releasable tube assembly with joining washer from a perspective view with the tubes joined.

Referring next to FIG. 10D, the releasable tube assembly 1020 with washer connector 390 is shown from a perspective view with male connector 370 in fluid connection with female connector 380 and with washer connector 390 in place at the intersection of the female connector 380 to male connector 370. Tube 140 is coupled to female connector 380 and tube 145 is coupled to male connector 370 in this view to form a fluid connection.

Figure 10E:
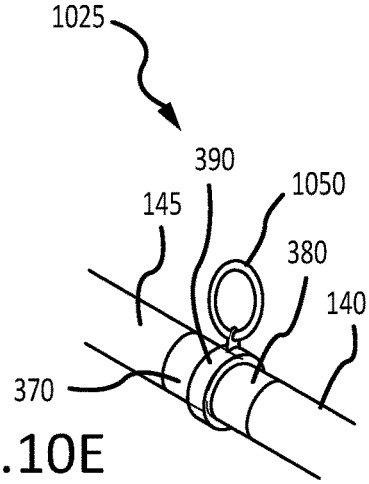
FIG. 10E depicts a releasable tube assembly with joining washer from a perspective view with the tubes disjoined with affixing washer attached.

Referring next to FIG. 10E, the releasable tube assembly 1025 with washer connector 390 is shown from a perspective view with male connector 370 in fluid connection female connector 380 and with washer connector 390 in place at the intersection of the female connector 380 to male connector 370. Tube 140 is coupled to female connector 380 and tube 145 is coupled to male connector 370 in this view to form a fluid connection. In this view ring 1050 is attached to washer connector 390 to provide washer connector 390 a mechanism to attach to an item such as a body-worn item or bag of some type.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Specific details are given in the above description to provide a thorough understanding of the embodiments. However, it is understood that the embodiments may be practiced without these specific details. While the principles of the disclosure have been described above in connection with specific apparatuses and methods, it is to be clearly understood that this description is made only by way of example and not as limitation on the scope of the disclosure.

While the principles of the disclosure have been described above in connection with specific apparatuses and methods, it is to be clearly understood that this description is made only by way of example and not as limitation on the scope of the disclosure.

What is claimed is:

1. A technology coupler for anchoring a tube in a body-worn item to promote fast uncoupling for maintenance, the technology coupler comprising:

a first port that is configured to releasably couple to a first tube to the technology coupler without fluid leaking;

a second port that is configured to releasably couple to a second tube to the technology coupler without fluid leaking, wherein the first port is in fluid communication with the second port; and an anchor, wherein:

the anchor is affixed to a body-worn item;

the anchor holds the first port and the second port in a concealed location proximate to the body-worn item; and the anchor is affixed in the concealed location of the body-worn item such that at least one of the first tube or second tube passes into the body-worn item to mate with the one of the first and second ports, respectively.

2. The technology coupler for anchoring a tube in a body-worn item to promote fast uncoupling for maintenance of claim 1, wherein the first tube or the second tube are non-releasably coupled to the first port or the second port, and/or the first tube and the second tube are permanently affixed to the first port or the second port.

3. The technology coupler for anchoring a tube in a body-worn item to promote fast uncoupling for maintenance of claim 1, further comprising an affixing mechanism including a magnet, a hook and loop fastener, a button, a button hole, and/or an eyelet.

4. The technology coupler for anchoring a tube in a body-worn item to promote fast uncoupling for maintenance of claim 1, wherein the first port and the second port are rigid or semi-rigid.

5. The technology coupler for anchoring a tube in a body-worn item to promote fast uncoupling for maintenance of claim 1, wherein the anchor is affixed to the body-worn item removably or non-removably.

6. The technology coupler for anchoring a tube in a body-worn item to promote fast uncoupling for maintenance of claim 1, wherein the first port and the second port are high-heat stable.

7. The technology coupler for anchoring a tube in a body-worn item to promote fast uncoupling for maintenance of claim 1, wherein the first port and the second port comprise food grade plastic material.

8. A technology coupler for anchoring a tube in a body-worn item to promote fast uncoupling for avoiding accidental catching, the technology coupler comprising:

a first port coupled to a first tube to the technology coupler;

a second port that is configured to releasably couple to a second tube to the technology coupler without fluid leaking, wherein the first port is in fluid communication with the second port; and an anchor, wherein:

the anchor is affixed to a body-worn item;

the anchor holds the first port in a concealed location proximate to the to body-worn item; and the anchor is affixed in the concealed location of the body-worn item such that at least one of the first tube or second tube passes into the body-worn item to mate with the one of the first and second ports, respectively.

9. The technology coupler for anchoring a tube in a body-worn item to promote fast uncoupling for avoiding accidental catching of claim 8, wherein the first port is configured to releasably couple to the first tube.

10. The technology coupler for anchoring a tube in a body-worn item to promote fast uncoupling for avoiding accidental catching of claim 8, wherein the first port and the second port are rigid or semi-rigid.

11. The technology coupler for anchoring a tube in a body-worn item to promote fast uncoupling for avoiding accidental catching of claim 8, wherein the anchor is affixed to the body-worn item removably or non-removably.

12. The technology coupler for anchoring a tube in a body-worn item to promote fast uncoupling for avoiding accidental catching of claim 8, wherein the first port and the second port are high-heat stable.

13. The technology coupler for anchoring a tube in a body-worn item to promote fast uncoupling for avoiding accidental catching of claim 8, wherein the first port and the second port comprise food grade plastic material.

14. The technology coupler for anchoring a tube in a body-worn item to promote fast uncoupling for avoiding accidental catching of claim 8, further comprising an affixing mechanism including a magnet, a hook and loop fastener, a button, a button hole, and/or an eyelet.

15. A technology coupler for anchoring a tube in a body-worn item to avoid strangulation, the technology coupler comprising:

a first port that is configured to releasably couple to a first tube to the technology coupler without fluid leaking;

a second tube, wherein the first port is in fluid communication with the second tube; and an anchor, wherein:

the anchor is affixed to a body-worn item;

the anchor holds the first port at a concealed location proximate to the body-worn item; and the anchor is affixed in the concealed location of the body-worn item such that at least one of the first tube or second tube passes into the body-worn item to mate with the one of the first and second ports, respectively.

16. The technology coupler for anchoring a tube in a body-worn item to avoid strangulation of claim 15, further comprising a second port configured to releasably couple to the second tube.

17. The technology coupler for anchoring a tube in a body-worn item to avoid strangulation of claim 15, wherein the anchor is affixed to the body-worn item removably or non-removably.

18. The technology coupler for anchoring a tube in a body-worn item to avoid strangulation of claim 15, wherein the first port is high heat stable.

19. The technology coupler for anchoring a tube in a body-worn item to avoid strangulation of claim 15, wherein the first port comprises food grade plastic material.

20. The technology coupler for anchoring a tube in a body-worn item to avoid strangulation of claim 15, further comprising an affixing mechanism including a magnet, a hook and loop fastener, a button, a button hole, and/or an eyelet.

* * * * *